US006466177B1

(12) United States Patent
Kunysz

(10) Patent No.: US 6,466,177 B1
(45) Date of Patent: Oct. 15, 2002

(54) CONTROLLED RADIATION PATTERN ARRAY ANTENNA USING SPIRAL SLOT ARRAY ELEMENTS

(75) Inventor: Waldemar Kunysz, Calgary (CA)

(73) Assignee: NovAtel, Inc., Calgary (CA)

( * ) Notice: Subject to any disclaimer, the term of this patent is extended or adjusted under 35 U.S.C. 154(b) by 0 days.

(21) Appl. No.: 09/915,112

(22) Filed: Jul. 25, 2001

(51) Int. Cl.[7] ..... H01Q 13/12; H01Q 13/10
(52) U.S. Cl. ..... 343/769; 343/770; 343/895
(58) Field of Search ..... 343/700 MS, 770, 343/895, 767, 769

(56) References Cited

U.S. PATENT DOCUMENTS

| | | | | |
|---|---|---|---|---|
| 3,925,784 A | * | 12/1975 | Phelan | 343/754 |
| 4,032,921 A | * | 6/1977 | Sikina, Jr. et al. | 343/895 |
| 5,146,234 A | | 9/1992 | Lalezari | 343/895 |
| 5,175,561 A | | 12/1992 | Goto | 343/769 |
| 5,307,077 A | * | 4/1994 | Branigan et al. | 343/720 |
| 5,581,268 A | | 12/1996 | Hirshfield | 343/853 |
| 5,621,422 A | * | 4/1997 | Wang | 343/895 |
| 5,694,416 A | | 12/1997 | Johnson | 375/206 |
| 5,815,122 A | | 9/1998 | Nurnberger et al. | 343/767 |
| 5,940,037 A | | 8/1999 | Kellerman et al. | 343/700 MS |
| 5,955,987 A | | 9/1999 | Murphy et al. | 342/357.06 |
| 5,995,044 A | | 11/1999 | Junysz et al. | 342/363 |
| 6,037,903 A | | 3/2000 | Lange et al. | 343/700 MS |
| 6,081,239 A | | 6/2000 | Sabet et al. | 343/753 |
| 6,128,557 A | | 10/2000 | Fenton et al. | 701/13 |
| 6,208,313 B1 | | 3/2001 | Frank et al. | 343/853 |
| 6,219,373 B1 | | 4/2001 | Lee et al. | 375/130 |
| 6,225,959 B1 | | 5/2001 | Gordon | 343/769 |
| 6,232,920 B1 | | 5/2001 | Brookner et al. | 342/372 |
| 6,236,367 B1 | | 5/2001 | Du Toit et al. | 343/700 MS |
| 2001/0048399 A1 | * | 12/2001 | Oberschmidt et al. | 343/770 |

OTHER PUBLICATIONS

Xian Hua Yang, Characteristics of Aperture Coupled Microstrip Antenna with Various Radiating Patched and Coupling Apertures, IEEE Transactions on Antennas and Propagation, Jan. 1995.

(List continued on next page.)

*Primary Examiner*—Don Wong
*Assistant Examiner*—Hoang Nguyen
(74) *Attorney, Agent, or Firm*—Cesari and McKenna, LLP

(57) ABSTRACT

A planar, controlled radiation pattern array antenna using spiral slot antenna arrays is disclosed. The CRPA antenna includes a nonconductive planar substrate with a plurality of transmission lines disposed on one surface. A conductive layer on the other surface of the substrate includes a plurality of slotted openings that form spiral slot array antennas such that each spiral slot array antenna opposed to a transmission line on the opposite side of the substrate.

11 Claims, 7 Drawing Sheets

OTHER PUBLICATIONS

Eli Aloni, Analysis of Dual Circularly Polarized Microstrip Antenna Fed by Crossed Slots, IEEE Transactions on Antennas and Propagation, Aug. 1994.

J.J. Picazo, On the Design of Nonuniformly Spaced Slot Arrays, IEEE Transactions on Antennas and Propagation, Nov. 1990.

Alison Brown, Kinematic Test Results of a Miniaturized GPS Antenna Array with Digital Beamsteering Electronics, ION NTM 2000, Jan. 2000.

A.J. Mac Millan, Cape—CRPA Associated Position Errors, ION NTM 2000, Jan. 2000.

Drew Williams, Four–Element Adaptive Array Evaluation fo United States Navy Airborne Applications, ION GPS 2000, Sep. 2000.

Basrur Rao, Chracterizing the Effects of Mutual Coupling on the Performance of a Miniturized GPS GPS Adaptive Antenna Array, ION GPS 2000, Sep. 2000.

Charles Manry Jr. Advanced Mini Array Antenna Design Using High Fidelity Computer Modeling and Simulation, ION GPS 2000, Sep. 2000.

Alison Brown, Test Results of Digital Beamforming GPS Receiver for Mobile Applications, ION NTM 2000, Jan. 2000.

D.M. Pozar, Reciprocity Method of Analysis for Printed Slot and Slot–Coupled Microstrip Antennas, IEEE Transactions on Antennas and propagation, Dec. 1986.

* cited by examiner

CONTROLLED RADIATION PATTERN ARRAY ANTENNA USING SPIRAL SLOT ARRAY ELEMENTS

FIELD OF THE INVENTION

The present invention is related to planar broadband array antennas and, more particularly, to controlled radiation pattern array antennas.

BACKGROUND OF THE INVENTION

Controlled Radiation Pattern Antennas (CRPA) are known in the art. A CRPA operates by using spatial filtering techniques to steer nulls in the antenna radiation pattern towards sources of interference. A CRPA is normally an array antenna comprised of a plurality of antenna elements. By controlling the phase gradients between antenna elements, the radiation pattern of the antenna can be controlled.

In prior art implementations of controlled radiation pattern atnennas, stacked patch dipole antennas are used as the array elements. U.S Pat. No. 5,955,987, granted to Murphy, et al, for example, discloses a CRPA antenna using three dipole antenna patches. U.S. Pat. No. 6,052,086, granted to Kudoh discloses an array antenna having a plurality of dipole patches on one side of a baseboard.

A four element controlled radiation pattern antenna using stacked patch dipole antennas is described in "Characterizing the Effects of Mutual Coupling on the Performance of Miniaturized GPS Adaptive Antenna Array" by Basrur Rao et al, ION GPS 2000, pages 2491–2498.

It is often desirable to be able to mount a controlled radiation pattern antenna on a vehicle. Many receivers for the global positioning system (GPS) utilize controlled radiation pattern antennas to reduce the effects of multipath or other interfering signals. However, many CRPAs are physically too large to fit within given form factors required by the host vehicle. Reduction in size of the antenna is possible, but this reduction in size brings the antenna elements closer together, thereby causing an increase in mutual coupling, which can negatively affect the performance of the array.

While the art describes controlled radiation pattern antennas, there remains a need for improvements that offer advantages and capabilities not found in presently available devices. Specifically, CRPA antennas are often larger than is desirable. Additionally, mutual coupling between adjacent antenna elements often reduces the performance of the antenna.

There is needed a CRPA antenna that can be made physically smaller, and there is a further need to reduce mutual coupling between adjacent antenna elements to improve antenna performance.

SUMMARY OF THE INVENTION

A controlled radiation pattern array antenna uses spiral slot array elements. The antenna comprises a substantially planar dielectric substrate having a first surface and a second surface. A conductive layer having a plurality of similar curved slotted openings is disposed on the first surface. The curved slotted openings form a plurality of spiral slot array antennas. The spiral slot array antennas are located such that the angle $\Phi$ between any two adjacent spiral slot array antennas with respect to the center of the antenna is equal to $2\pi/N$, wherein N is the number of spiral slot array antennas.

A plurality of transmission lines is disposed on the second surface of the antenna with each transmission line being aligned with a corresponding spiral slot array antenna on the first surface. Each antenna element comprising of the spiral slot array and the transmission line located underneath is rotated about its center such that adjacent antenna elements are rotated by $2\pi/N$ with respect to each other. The rotation of $2\pi/N$ between adjacent elements randomizes the pattern error of each individual element yielding a very uniform radiation pattern of a combined array of all antenna elements.

BRIEF DESCRIPTION OF THE DRAWINGS

The invention description below refers to the accompanying drawings, of which.

DETAILED DESCRIPTION OF ILLUSTRATIVE EMBODIMENTS

Figure 1:
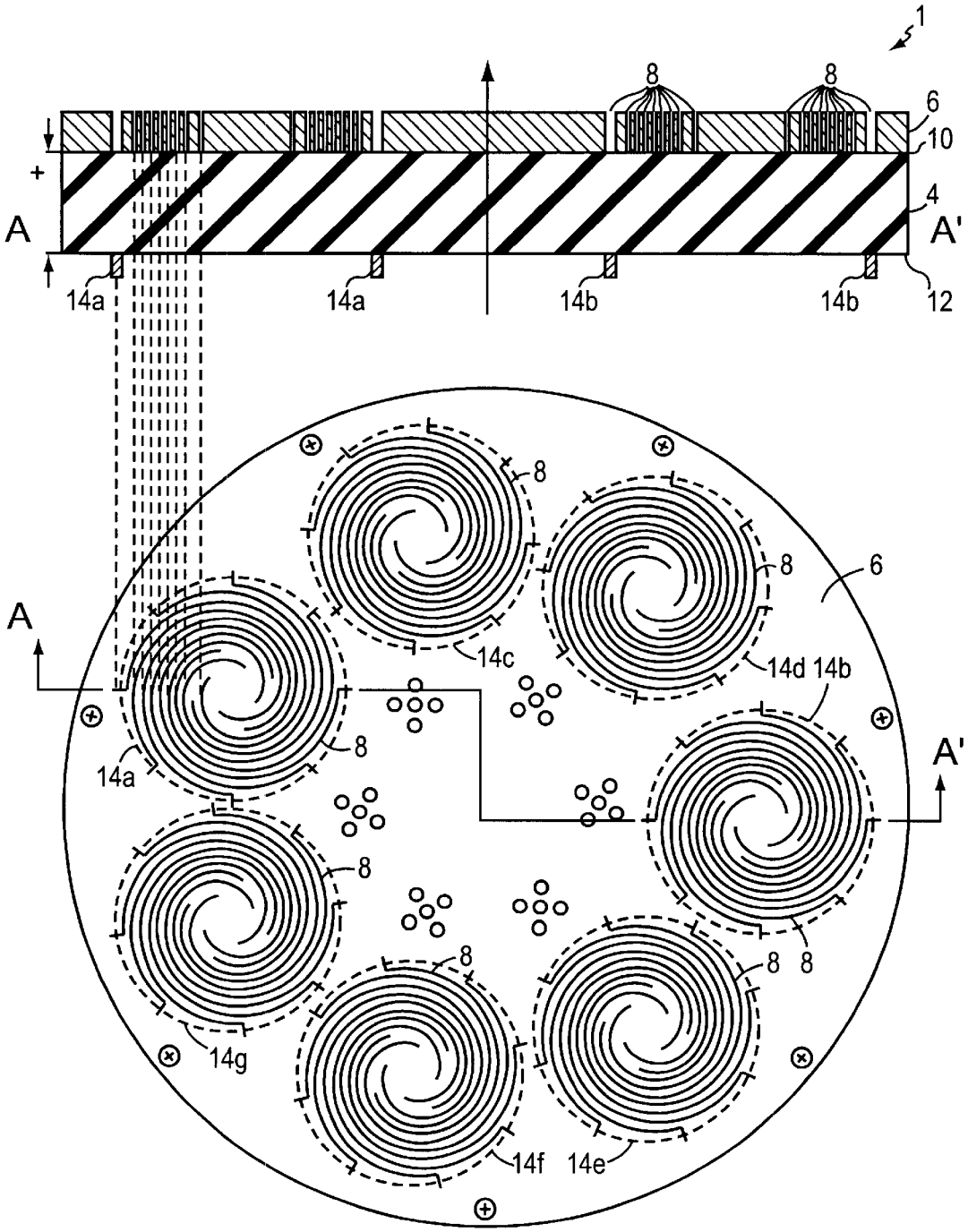
FIG. 1 is a top view of an antenna according to an illustrative embodiment of this invention and a cross-sectional view of the antenna through line A—A'.

FIG. 1 shows a top and cross-sectional view of a controlled radiation pattern antenna 1 in accordance with an illustrative embodiment of this invention. The cross sectional view is taken along line A—A' of the top view. The antenna comprises a substantially planar substrate 4 of nonconductive or dielectric material having a thickness t, with a conductive layer 6 having a plurality of curved slotted openings 8 disposed on a first surface 10 and a plurality of transmission lines 14 disposed on a second surface 12. On the top view, transmission lines 14*a*, 14*b*, 14*c*, 14*d*, 14*e*, 14*f* and 14*g* are shown in shadow, as they are disposed on the second surface of the antenna.

Any dielectric material may be used for the substrate 4. In a preferred embodiment, the substrate is RO3006™ available from Rogers Corporation of Chandler, AZ. It should be noted that it is expressly contemplated that other substrates may be utilized in accordance with this invention.

As is well known in the relevant art, the size of the antenna will be affected by the dielectric constant of the choice of substrate. A substrate 4 having a higher dielectric constant will enable one to make the antenna physically smaller. Conversely, a substrate 4 with a lower dielectric constant will cause the antenna to be physically larger. There are disadvantages to using higher dielectric materials. As those skilled in the art know, the higher the dielectric constant of a substrate used in an antenna, the narrower the bandwidth of the antenna. Conversely, by using a lower dielectric constant material, the antenna's bandwidth will be wider, but the physical size will also increase. The invention can utilize a substrate having any dielectric constant, with the substrate chosen to allow the antenna to conform to either the requisite form factor or bandwidth as desired.

In an illustrative embodiment, antenna 1 may be fabricated from a two-layer printed circuit board (PCB), where the transmission lines 14 and the slotted openings 8 can be formed by suitably etching portions of the respective cladding layers to form the slotted openings 8 and the transmission lines 14. Transmission line 14 shall stand for any transmission line 14*a*, 14*b*, 14*c*, 14*d*, 14*e*, 14*f* and 14*g*.

Figure 2:
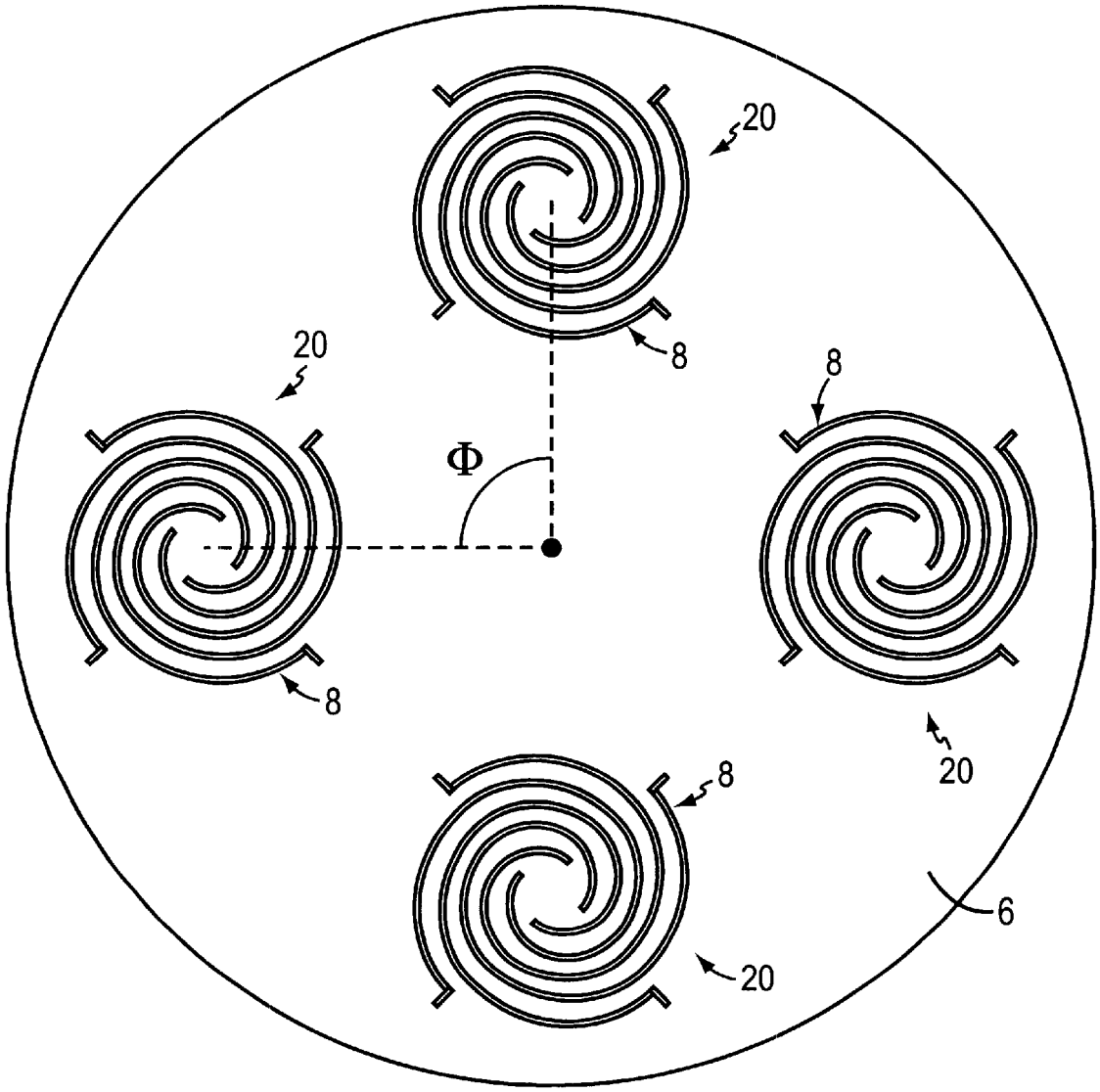
FIG. 2 is a planar view showing the first surface of a CRPA antenna having a plurality of spiral slot array antenna elements.

FIG. 2 is a view the first surface 10 of an illustrative embodiment of a CRPA antenna 1 using spiral slot array antenna elements. A conductive layer 6 covers the first surface 10 of the substrate 4. The conductive layer 6 includes a plurality of similar curved, slotted, openings 8 where each slotted opening extends through the conductive layer 6 to the front surface of the substrate 4. The plurality of curved, slotted openings 8 form spiral slot array antennas 20 (SSAA) which are further described below. The antenna 1 is thus an array of arrays, with the antenna 1 comprising a plurality of spiral slot array antennas 20 and each spiral slot array antenna 20 comprising a plurality of spiral slot antennas.

Each SSAA 20 is located so that angle $\phi$ between any SSAA 20 and an adjacent SSAA 20 is $2\pi/N$ radians with respect to the antenna center 16, wherein N is the number of spiral slot array antennas. Thus, in this illustrative embodiment, $\phi=\pi/2$.

The curved slotted openings 8 can be any shaped spiral, including a conical section (i.e., a circular, elliptical, parabolic, or hyperbolic arc), an Archimedean spiral, a logarithmic spiral, or an exponential spiral. The spirals could even be of a free-hand type. The only constraint to a free-hand curve is that the length of the curve must be accurately determined in order for it to resonate at the desired frequency. Spiral slots are used to maintain constant spacing between adjacent elements at a given distance from the center. This constant distance minimizes cross-coupling and radiation of unwanted cross-polarized signals.

Figure 3:
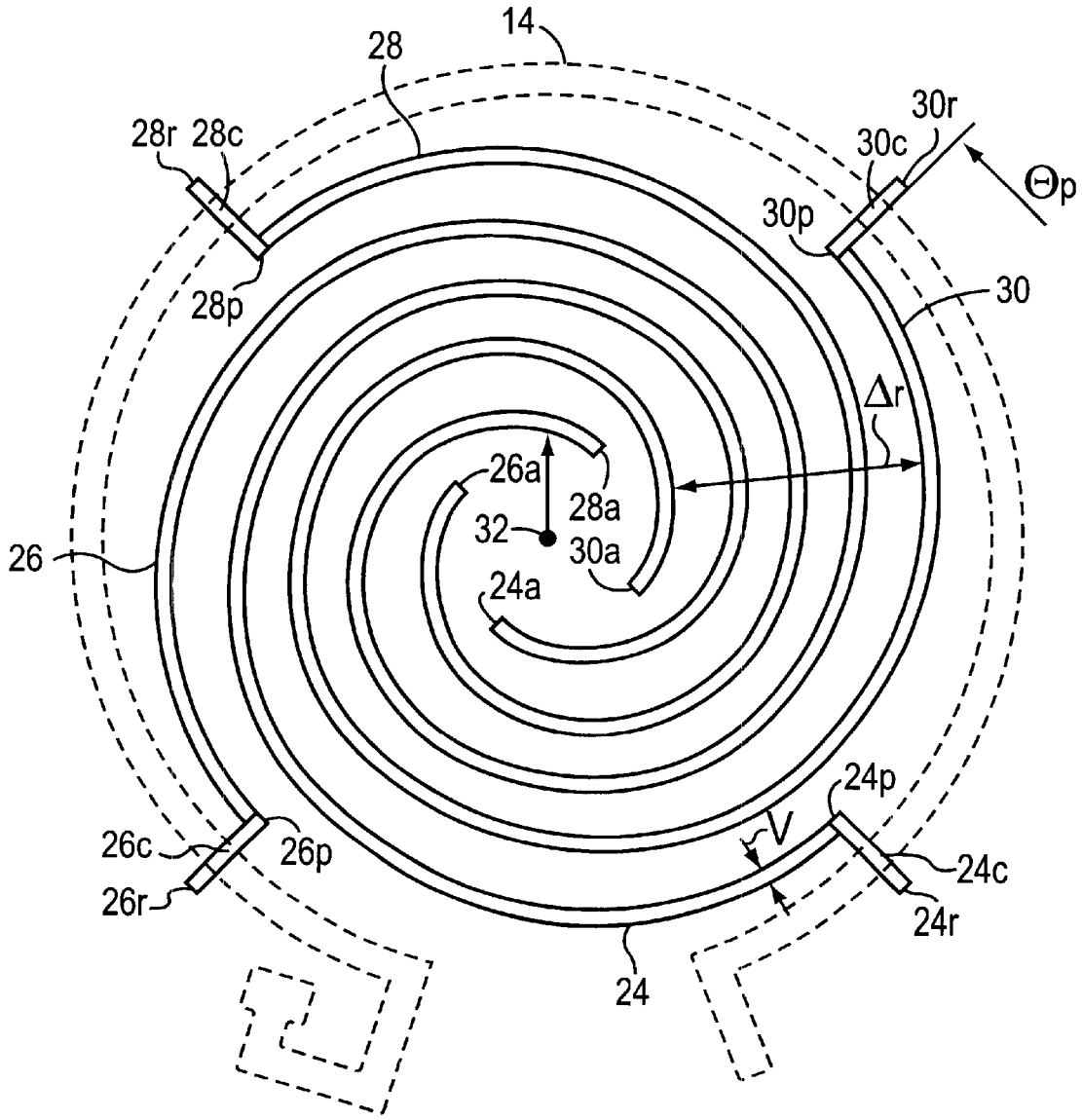
FIG. 3 is a planar view of an illustrative spiral slot array antenna.

FIG. 3 shows an illustrative SSAA 20 in greater detail from the top. Reference is made to U.S. patent application Ser. No. 09/375,319, filed Aug. 16, 1999 entitled "Aperture Coupled Slot Array Antenna" which teaches spiral slot array antennas and which is hereby incorporated by reference.

SSAA 20 is comprised of slots 24, 26, 28 and 30. The slots have respective axial ends 24*a*, 26*a*, 28*a* and 30*a* proximate the SSAA center 32, and respective peripheral ends 24*p*, 26*p*, 28*p* and 30*p*. Each peripheral end is connected to a radiating slot line 24*r*, 26*r*, 28*r* and 30*r* respectively. Radiating slot lines 24*r*, 26*r*, 28*r* and 30*r* are situated such that they are perpendicular to transmission line 40 (shown in shadow) which is disposed on the second surface of the substrate.

Accordingly, when the antenna is used to transmit signals, electromagnetic energy is fed into the transmission line 14, which is located on the back surface of the substrate, and is electromagnetically coupled to the slotted openings 24, 26, 28 and 30, which are on the front surface of the antenna. This coupling occurs at the four respective coupling regions 24*c*, 26*c*, 28*c* and 30*c* where the radiating slot lines 24*r*, 26*r*, 28*r* and 30*r*, which lie on the front surface, are located most proximate to and directly opposite the transmission line 40 which lies on the back surface of the substrate. It should be expressly noted that in the invention, the transmission lines encircle the majority of the spiral slot array antennas, which is unlike the SSAA taught by the incorporated patent. Additionally, the referenced patent does not teach the use of radiating slot lines that are perpendicular to the transmissions lines. By being perpendicular, the radiating slot lines couple with the transmission line better than if they "crossed" at any other angle.

For example, a portion of the radiating slot lines 24*r*, 26*r*, 28*r* and 30*r* are located a distance equivalent to the substrate thickness t from the transmission line at coupling regions 24*c*, 26*c*, 28*c* and 30*c*. As is well known in the relevant art, the electromagnetic energy passing through transmission line 40 will produce a radiating field across the radiating slot lines 24*r*, 26*r*, 28*r* and 30*r* in the coupling regions 24*c*, 26*c*, 28*c* and 30*c*. This electromagnetic energy will be similarly transferred into the slotted openings 24, 26, 28 and 30 from the radiating slot lines coupling regions 24*r*, 26*r*, 28*r* and 30*r* respectively.

The degree of coupling is a function of the thickness t of the substrate, the width w of the transmission line, the width v of the slotted opening, and the dielectric properties of the substrate. Conversely, when the antenna is used to receive signals, radiation energy is received at the slotted openings 24, 26, 28, 30 is transferred into the radiating slot lines 24*r*, 26*r*, 28*r* and 30*r*. From the radiating slot lines 24*r*, 26*r*, 28*r* and 30*r*, the electromagnetic energy is then coupled into the transmission line 40 at the coupling regions 24*c*, 26*c*, 28*c* and 30*c*.

Unwanted cross-polarization is minimized by keeping the opening width v narrow in comparison to the guided wave length $L_{gw}$. The shape of each of the slotted openings, from the axial end to the peripheral end, can be described best in polar coordinates using the antenna axis 32 as origin. The radial distances $R(\theta)$ of the interior edges of the slotted openings increase from $r_a$ at the respective axial, to a maximum radius of $r_p$ at the respective peripheral. The radial distance from the antenna axis to the inside edge of any of the slotted opening increases with the polar angle $\theta$ and is also a function of the interval spacing $\Delta r$ for each spiral-shaped slotted opening where $\Delta r \equiv r(\theta+2\pi)-r(\theta)$. For the slotted opening, the radial distance from the antenna axis can be described by means of the equation, $$r(\theta,\Delta r)=r_a+\Delta r(\theta/2\pi) \tag{1}$$

Each slotted opening is spatially offset from each adjacent opening by $2\pi/N$ radians. Thus, in this illustrative embodiment, each opening is offset by $\pi/2$ radians. The guided wave length of each of the slotted openings is specified to be a multiple of quarter-wavelengths of the receiving or transmitting signal in order to maximize the antenna efficiency $$\left(\text{i.e., } L_{GW} = \frac{n\lambda}{4}\right).$$

In the configuration shown, each spiral-shaped slotted openings 24, 26, 28, 30 subtends an angle of $\theta_p$, where $$\frac{n\lambda}{4} = \int_0^{\theta_p}\left(\frac{\Delta r}{2\pi}\sqrt{1+\theta^2}\right)d\theta \tag{2}$$

The width v of each of the slotted openings 24, 26, 28, 30 is specified to be substantially smaller than the guided wave length and large enough to enable good electromagnetic coupling between the respective slotted opening 24, 26, 28, 30 and a transmission line 40. Methods of optimizing the width and wavelength to create good electromagnetic coupling are well known in the art. These methods are described in J. J. Gonzalez Picazo, "On the Design of Nonuniformly Spaced Slot Arrays," IEEE Transactions on Antennas and Propagation, Vol. 38, no. 11, pp. 1780–1783, 1990; Eli Aloni, "Analysis of a Dual Circularly Polarized Microstrip Antenna Fed by Crossed Slots," IEEE Transactions on Antennas and Propagation, vol. 42, no. 8, pp. 1053–1058, 1994; David Pozar, "Reciprocity Method of Analysis for Printed Slot and Slot-Coupled Microstrip Antennas," IEEE Transactions on Antennas and Propagation, vol. 34, no. 12, p1439, 1986; and Xian Yang, "Characteristics of Aperture Coupled Microstrip Antennas with Various Radiating patches and Coupling Apertures," IEEE Transactions on Antennas and Propagation, vol. 43, no. 1, 1995 which are hereby incorporated by reference.

The transmission line 40 "crosses" each of the slotted openings 24, 26, 28, 30 at respective coupling regions 24*c*, 26*c*, 28*c* and 30*c*. The coupling regions 24*c*, 26*c*, 28*c* and 30*c* are offset by $2\pi/N$ radians from one another. This configuration provides for matching the electrical phase differences in the coupling regions (i.e., in this illustrative embodiment the differences are 90°) with the spatial differences of the slotted openings when the guided wave length of the transmission line is tuned to be one wavelength $\lambda_1$.

Figure 4:
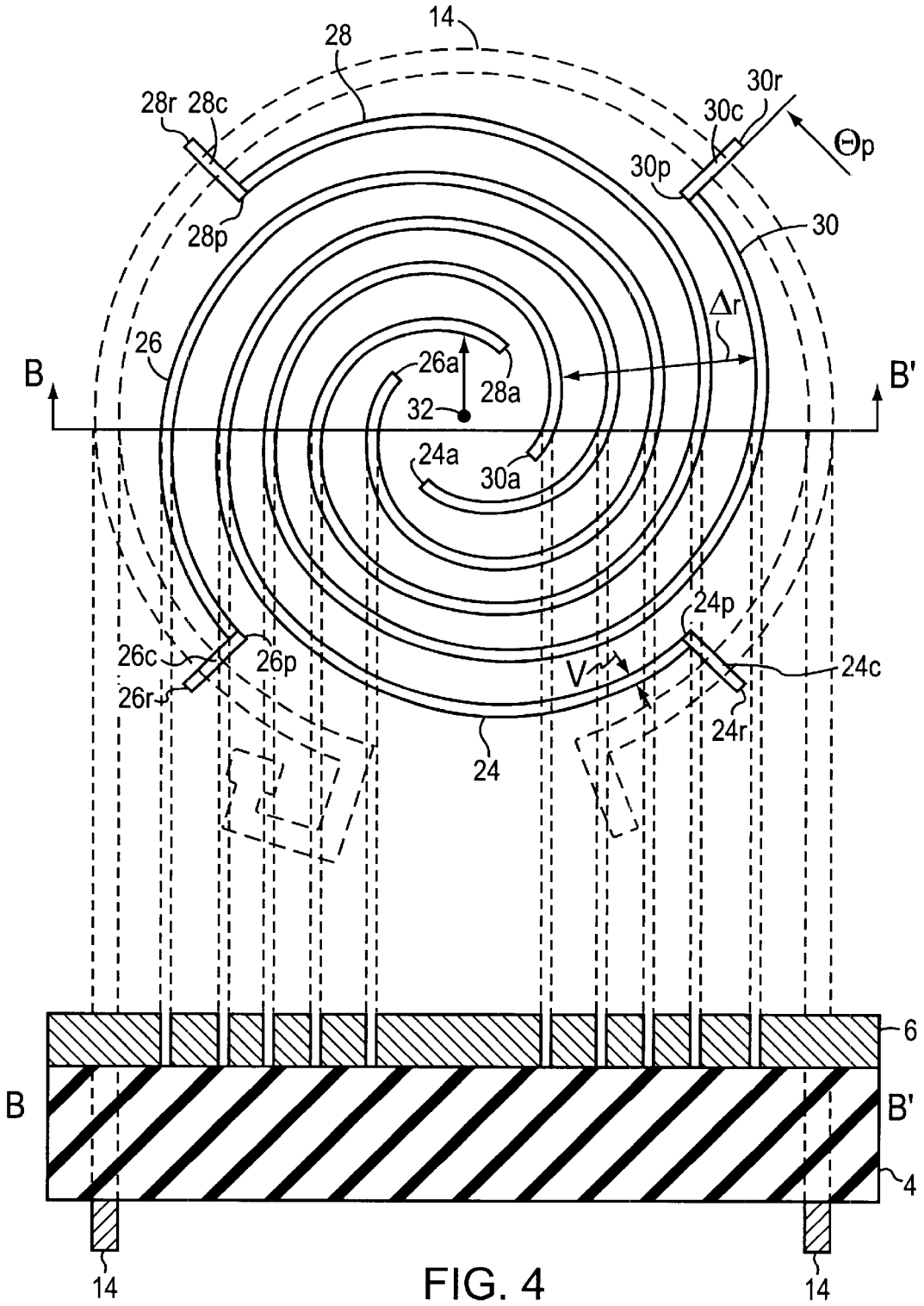
FIG. 4 is a planar and cross-sectional view of an illustrative spiral slot array antenna.

FIG. 4 is a cross-sectional and top view of an illustrative spiral slot array antenna. The cross sectional view along line B—B' shows the slotted openings 24, 26, 28 and 30 are cut into the conductive layer 6 which is disposed on the first surface of the substrate 4. The transmission line 14, which is shown in shadow in the top view, is disposed on the second surface of the conductive layer 4 in the cross-sectional view.

Figure 5:
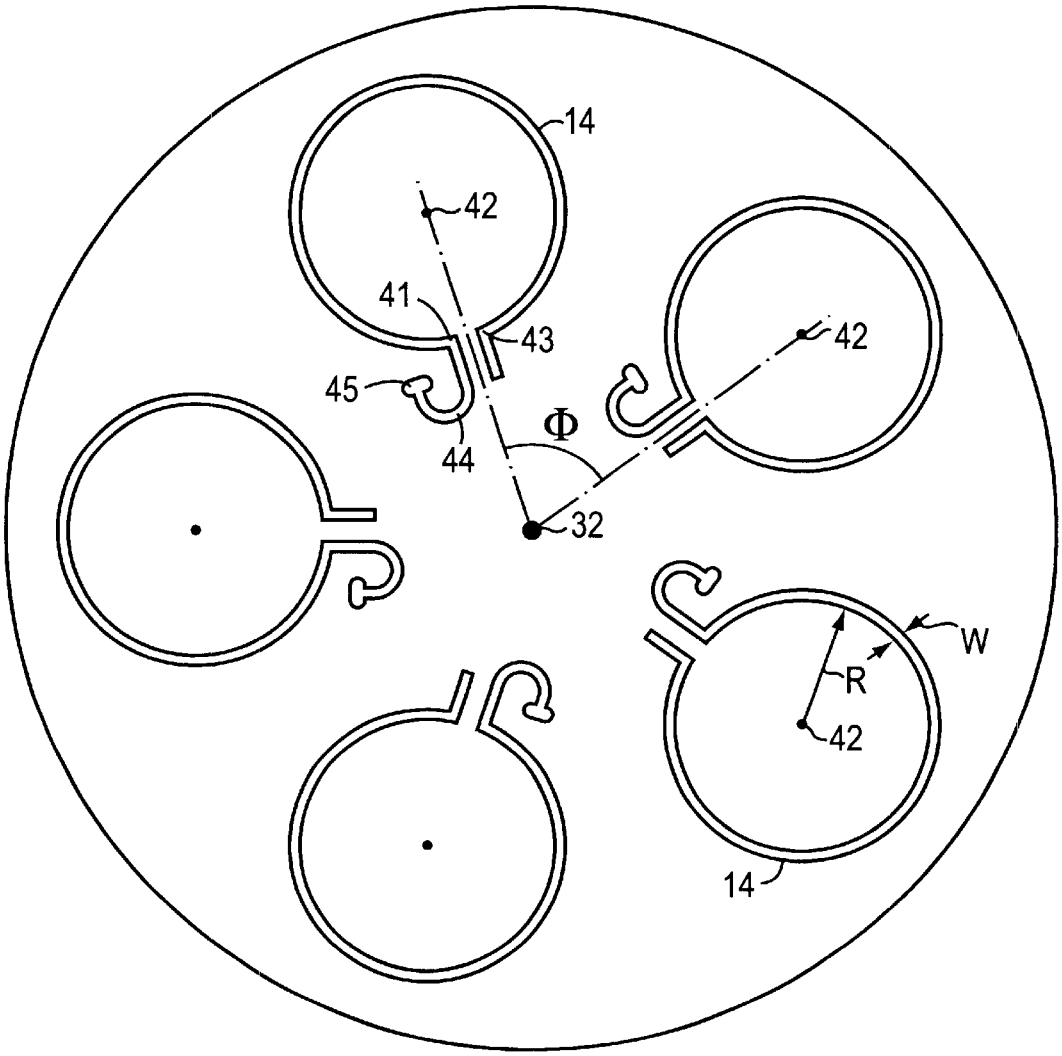
FIG. 5 shows the second surface of a CRPA antenna having a plurality of transmission lines disposed on the second surface.

FIG. 5 is a view of the second surface 12 of an antenna 1 according to an illustrative embodiment of this invention. Transmission lines 14 are disposed on the second surface 12 such that the center 42 of each transmission line is aligned with a center 22 of a SSAA 20 on the first surface 10 of the antenna. Thus angle $\phi$, the angle between any two adjacent transmission lines 14 with respect to the antenna center 32, is the same as the angle between any two adjacent SSAAs 20 on the first surface 10 of the antenna 1. Angle $\phi=2\pi/N$, wherein N is the number of SSAAs 20 in the antenna 1. Thus, in this illustrative embodiment $\phi=\pi/2$.

A connector 45 is electrically connected to a first conductive lead 44 and to an input end 41 of transmission line 14. A second conductive lead 46 is electrically connected to load impedance 48 and to a terminal end 43 of transmission line 40. The transmission lines 14 are in the shape of a circular arc, where an inside edge of the transmission line lies at a radius of R and an outside edge lies at a radius of R+w from the transmission line center 42. The length of the transmission line 40 measured from the input end to the terminal end should be equal to the desired wavelength.

Figure 6:
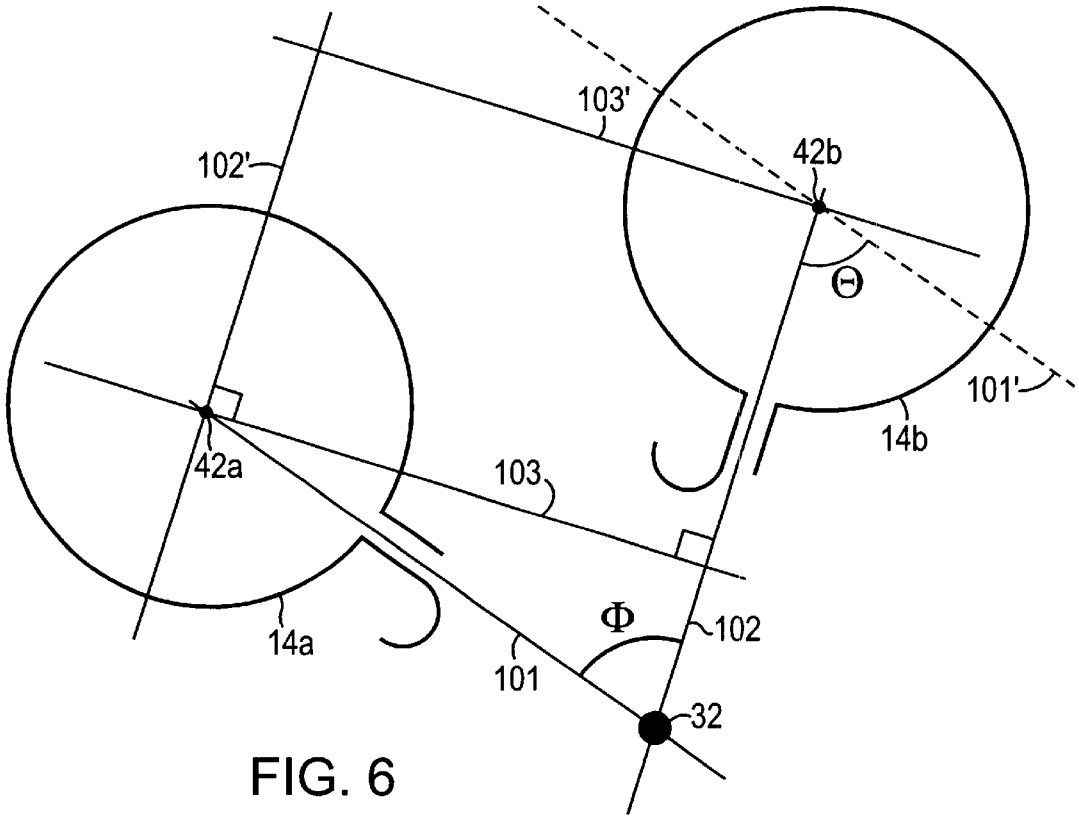
FIG. 6 shows the rotation of a transmission line relative to any adjacent transmission line.

Additionally, each transmission line 14 is rotated about its transmission line center 42 with respect to an adjacent transmission line 14. This rotation around transmission line center 42 is shown in FIG. 6. Transmission lines 14*a* and 14*b* have centers 42*a* and 42*b* respectively. Radii 101 and 102 form angle $\phi$. Line 101' is parallel to radius 101. Lines 103 and 103' are parallel, as are lines 102 and 102'. Line 102 is perpendicular to line 103. The angle $\theta$ formed by line 101' and radius 102 is the angle of rotation of transmission line 14*b* with respect to transmission line 14*a*. In a preferred embodiment $\theta=2\pi/N$. Additionally, the corresponding SSAA on the first surface is also rotated about its center by the same amount. Thus, each element, including the transmission line and the spiral slot array antenna, is rotated around its center $\theta$, wherein in a preferred embodiment $\theta=2\pi/N$.

Figure 7:
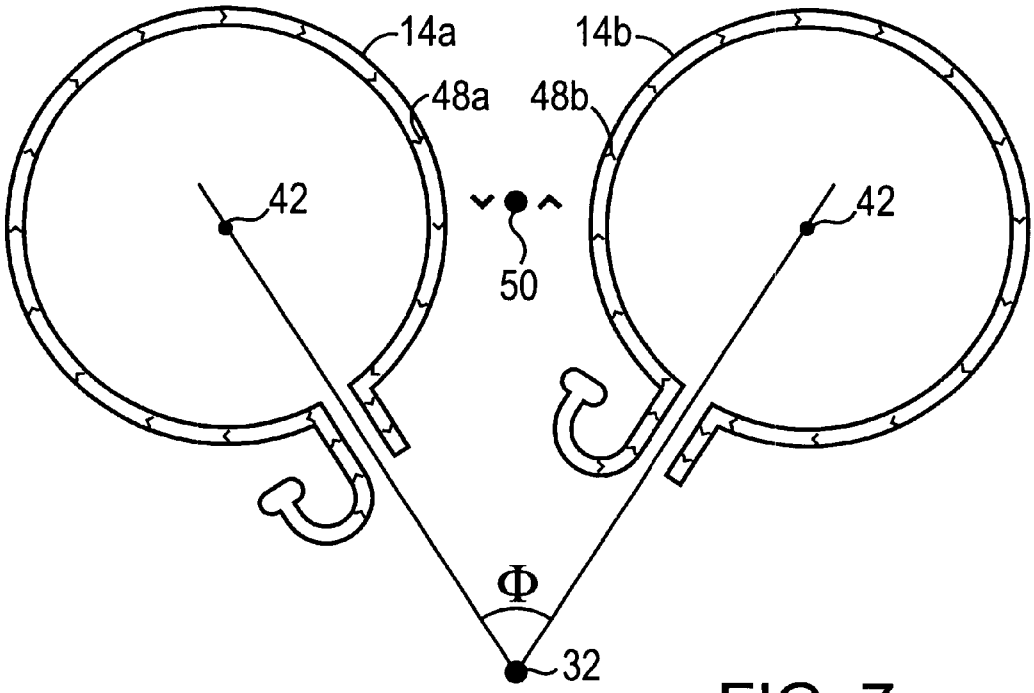
FIG. 7 shows the current flows through adjacent transmission lines.

When $\theta=\phi$, the electric current in the transmission lines flows in opposite directions in adjacent elements. FIG. 7 shows this current flow. In transmission line 14*a*, current 48*a* enters the input end 41*a* via connector 45*a* and first conductive lead 46*a*. Current 48*b* enters transmission line 40*b* via the input end 41*b* via connector 45*b* and first conductive lead 46*b*. At point 50, the closest that transmission line 14*a* and 14*b* are located, currents 48*a* and 48*b* are flowing in opposite directions. This arrangement reduces mutual coupling between adjacent antenna elements, enabling a smaller physical antenna in accordance with this invention.

While the invention has been described with reference to particular embodiments, it will be understood that the present invention is by no means limited to the particular constructions and methods herein disclosed and/or shown in the drawings, but also comprises any modifications or equivalents within the scope of the claims. Specifically, it is expressly contemplated that other numbers of spiral slot array antennas may be used as antenna elements. It is also expressly contemplated that each spiral slot array antenna may have other numbers of spiral slot antenna elements. As an illustrative example, it is expressly contemplated that an antenna in accordance with this invention has nine spiral slot array antennas as elements, with each SSAA having six spiral slot antennas.

What is claimed is:

1. A controlled radiation pattern array antenna, the antenna comprising:

a substantially planar dielectric substrate having a front surface and a back surface;

a conductive layer disposed on the front surface;

a plurality of similar curved, slotted openings extending through the conductive layer to the substrate, the slotted openings forming a plurality of spiral slot arrays;

a plurality of transmission lines disposed on the back surface of the substrate such that the transmission lines are aligned with the spiral slot arrays.

2. The antenna of claim 1 further comprising:

a dielectric substance filling the curved, slotted openings.

3. The antenna of claim 1 wherein each of the plurality of curved slotted openings further comprises:

a shape selected from the group consisting of a conical-section arc, a spiral arc, a logarithmic arc, and an exponential arc.

4. The antenna of claim 1 wherein each antenna element comprising of one of the spiral slot arrays and its corresponding transmission line forms a portion of an arc surrounding a center wherein each antenna element is rotated around its center by $2\pi/N$ with respect to the orientation of an adjacent antenna element, wherein N is the number of spiral slot array antennas elements.

5. The antenna of claim 1 wherein the spiral slot array antennas are located such that the angle between any two adjacent spiral slot array antennas with respect to the antenna center is $2\pi/N$.

6. The antenna of claim 1 wherein each spiral slot array antenna further comprises:

a plurality of spiral slot antennas;

each spiral slot antenna having a radiating slot line extending radially from an end of the spiral slot antenna farthest from the antenna center such that the radiating slot line is substantially perpendicular to a transmission line.

7. The antenna of claim 1 wherein each transmission line is rotated around its center by $2\pi/N$ with respect to the orientation of an adjacent transmission line, wherein N is the number of spiral slot array antennas and wherein the spiral slot array antennas are located such that the angle between any two adjacent spiral slot array antennas with respect to the antenna center is $2\pi/N$.

8. A controlled radiation pattern array antenna, the antenna comprising: a substantially planar dielectric substrate having a front surface and a back surface containing an antenna center;

a conductive layer, the conductive layer being disposed on the front surface of the substrate;

a plurality of similar curved, slotted openings extending through the conductive layer to the substrate, the openings forming a plurality of spiral slot array antennas;

a plurality of transmission lines, the transmission lines being disposed on the back surface of the substrate such that the transmission lines are aligned with the spiral slot array antennas;

each transmission line forming a portion of an arc of radius R surround a transmission line center, each transmission line being rotated around its center by $2\pi/N$ with respect to the orientation of an adjacent transmission line, wherein N is the number of spiral slot array antennas, and the spiral slot array antennas located such that the angle between any two adjacent spiral slot array antennas with respect to the antenna center is $2\pi/N$.

9. A spiral slot array antenna, the antenna comprising:

a substantially planar nonconductive substrate having a first surface and a second surface and containing an antenna center;

a conductive layer disposed on the first surface of the substrate; a transmission line forming a portion of an arc centered on the antenna center and having a first end and a second end disposed on the second surface of the substrate, the first end connected to a first conductive lead, the first conductive lead connected to a connector, the second end connected to a second conductive lead, the second conductive lead connected to a terminal impedance;

a plurality of curved, slotted openings extending through the conductive layer to the first surface substrate, the openings forming a plurality of spiral slot antennas centered on the antenna center, wherein each spiral slot antenna has a radiating slot line extending radially away from an end of the spiral slot antenna furthest away from the antenna center such that each radiating slot line is substantially perpendicular to the transmission line.

10. An antenna array, the antenna array comprising:

a substantially planar dielectric substrate having a front surface and a back surface;

a conductive layer disposed on the front surface;

a first array of a plurality or curved, slotted opening extending through the conductive layer to the substrate;

an array of the first arrays forming an antenna formed from an array of the first arrays; and a plurality of transmission lines disposed on the back surface of the substrate such that the transmission lines are aligned with the first arrays.

11. A method for making a controlled radiation pattern antenna, the method comprising the steps of:

placing a conductive layer on a front surface of a substantially planar dielectric surface;

forming a first array of a plurality of curved, slotted openings extending through the conductive layer to the substrate; and forming an array of the first arrays to form an antenna formed from an array of the first arrays.

* * * * *